United States Patent [19]

Mizuno

[11] 4,367,722

[45] Jan. 11, 1983

[54] CONTACTLESS IGNITION SYSTEM FOR INTERNAL COMBUSTION ENGINE

[75] Inventor: Tiaki Mizuno, Toyota, Japan

[73] Assignee: Nippondenso Co., Ltd., Kariya, Japan

[21] Appl. No.: 190,255

[22] Filed: Sep. 24, 1980

[30] Foreign Application Priority Data

Sep. 27, 1979 [JP] Japan ..... 54-125119

[51] Int. Cl.[3] ..... F02P 1/00

[52] U.S. Cl. ..... 123/644; 123/630; 123/609

[58] Field of Search ..... 123/644, 609, 611

[56] References Cited

U.S. PATENT DOCUMENTS

| | | | |
|---|---|---|---|
| 3,831,571 | 8/1974 | Weber | 123/644 |
| 3,882,840 | 5/1975 | Adamian et al. | 123/644 |
| 3,937,193 | 2/1976 | Kim | 123/644 |
| 4,167,927 | 9/1979 | Mikami et al. | 123/609 |
| 4,228,779 | 10/1980 | Wetzel | 123/644 |
| 4,248,200 | 2/1981 | Sugiura et al. | 123/644 |

*Primary Examiner*—Ronald B. Cox

*Attorney, Agent, or Firm*—Cushman, Darby & Cushman

[57] ABSTRACT

An off-time control circuit drives an output transistor connected in series with a primary winding of an ignition coil while controlling the off-time in each ignition period so that the ratio $T_i/T$ between the period of time $T_i$, during which the level of primary current supplied to the primary winding of the ignition coil attains a predetermined setting, and the ignition period can be maintained constant. The output from a current detecting resistor connected to the primary winding is applied to a rising time detecting circuit which detects the rising time of the primary current from the current supply starting time to the time of attainment of the predetermined setting. The off-time control circuit controls the starting time of power supplied to the output transistor depending on the output from the rising time detecting circuit.

4 Claims, 5 Drawing Figures

CONTACTLESS IGNITION SYSTEM FOR INTERNAL COMBUSTION ENGINE

BACKGROUND OF THE INVENTION

1. Field of the Invention

This invention relates to a contactless ignition system provided with a dwell angle control device for igniting an internal combustion engine, especially, that used for driving an automotive vehicle.

2. Description of the Prior Art

A contactless ignition system of this kind is disclosed in, for example, U.S. Pat. No. 3,605,713. FIG. 1 shows the waveform of primary current $i_c$ supplied to the ignition coil in such a disclosed ignition system. The disclosed system includes closed-loop control means so that the primary current $i_c$ supplied to the ignition coil until immediately before the generating timing of spark ignition voltage across the ignition coil can be maintained at a predetermined current level $i_{co}$ for a controlled period of time $T_i$ of a predetermined value as shown in FIG. 1. When, for example, the period of time $T_1$ exceeds the predetermined value, the starting timing of primary current supply to the ignition coil is delayed to shorten the duration $T_{ON}$ of current supply to the ignition coil thereby maintaining the period of time $T_i$ at the predetermined value. Such a manner of feedback control is continuously carried out to control the duration $T_{ON}$ of primary current supply to the ignition coil, hence, to control the dwell time so that the period of time $T_i$ can always be stably maintained at the predetermined value.

In FIG. 1, $T_c=(T_{ON}-T_i)$ represents the period of time or rising time required for the primary current $i_c$ supplied to the ignition coil until it rises to its predetermined level $i_{co}$ from its zero level. It is known that non-uniformity of inductance components of ignition coils within manufacturing tolerances occurs during manufacture of a lot of such coils and appears directly as a corresponding non-uniformity of the length of the rising time $T_c$. In the aforementioned prior art ignition system, a $T_i$ feedback function is provided for comparing the detected actual value of $T_i$ with its reference value $T_{io}$ so that the duration $T_{ON}$ of primary current supply can be controlled depending on the error $\Delta T_i=T_i-T_{io}$. Thus, when, for example, the inductance of the ignition coil employed is lower by 10% than the designed setting, and consequently, the rising time $T_c$ is shorter by 10% than the designed setting, the duration $T_{ON}$ of primary current supply must also be selected to be shorter by about 10% than the designed setting.

In the prior art control system, the duration $T_{ON}$ of primary current supply to the ignition coil is determined depending on the error $\Delta T_i=T_i-T_{io}$ regardless of the difference in inductance of each ignition coil. Therefore, when the inductance of the ignition coil is lower than the designed setting due to the manufacturing tolerances, $T_c$ will become shorter and $T_i$ will become substantially longer within the determined duration $T_{ON}$ of primary current supply to the ignition coil. This means that excessive heat is generated in the output stage transistor and also in the ignition coil resulting in a great temperature rise of these elements. Because of such non-uniformity of the inductance, the heat radiating fins of the output stage transistor had to be sized to be considerably larger than the size calculated according to the indexes of standard heat generation in the contactless ignition system, resulting in difficulty of attaining the desired miniaturization of the output stage transistor. When, on the other hand, the inductance of the ignition coil is higher than the designed setting, $T_c$ will become longer and $T_i$ will become substantially shorter within the determined duration $T_{ON}$ of primary current supply. The ignition system including such an ignition coil has been defective in that the primary current $i_c$ supplied to the ignition coil will not attain the predetermined level $i_{co}$ in a worst case resulting in impossibility of exhibition of the desired spark ignition performance.

SUMMARY OF THE PRESENT INVENTION

With a view to obviate such prior art defects, it is a primary object of the present invention to provide a novel and improved contactless ignition system for an internal combustion engine which ensures the desired stable spark ignition performance in any one of the rotational speed ranges regardless of a deviation of the inductance of the ignition coil from the designed setting due to the manufacturing tolerances and other factors.

In a preferred embodiment of the present invention which attains the above object, the rising time $T_c$ required for the primary current $i_c$ to rise to its predetermined level $i_{co}$ from its zero level is detected by a $T_c$ detecting circuit connected to a current detecting resistor continuously detecting the level of the primary current $i_c$ supplied to the ignition coil, so that the dwell angle of the ignition coil can be controlled on the basis of the current level detected by the resistor.

BRIEF DESCRIPTION OF THE DRAWINGS

These and other objects, features and advantages of the present invention will be apparent from the following detailed description taken in conjunction with the accompanying drawings, in which.

DESCRIPTION OF THE PREFERRED EMBODIMENTS

Figure 2:
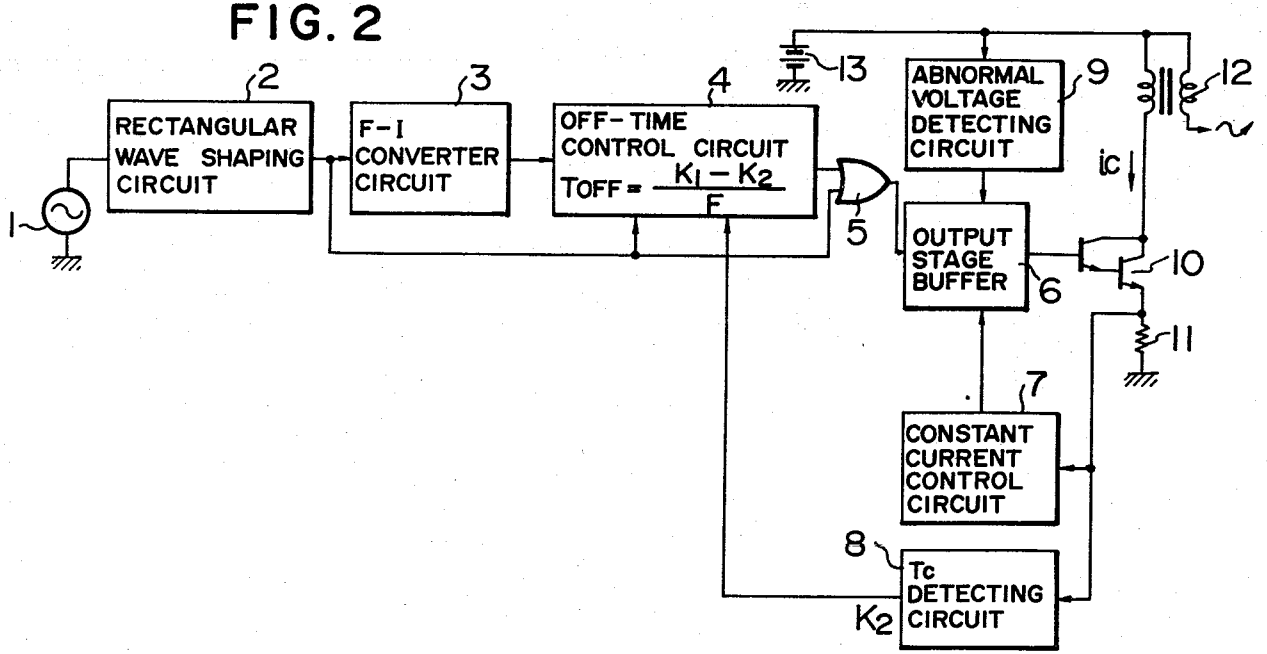
FIG. 2 is a block diagram of a preferred embodiment of the contactless ignition system according to the present invention.

A preferred embodiment of the present invention will now be described in detail with reference to the drawings. Referring first to FIG. 2 which is a block diagram of the embodiment, a known AC generator 1 rotating in synchronism with an internal combustion engine applies its AC output to a rectangular wave shaping circuit 2. In the range of low rotational speeds such as an idling rotational speed of the engine, the output from the rectangular wave shaping circuit 2 passes through an OR circuit 5 and an output stage buffer 6 to directly trigger an output stage transistor 10 which acts as a means for interrupting primary current $i_c$ supplied to an ignition coil 12. In the ranges of intermediate and high engine rotational speed, the output from the rectangular wave shaping circuit 2 is applied to an F-I converter circuit 3, which generates an output current corresponding to an input frequency, and the output from the F-I converter circuit 3 is applied to an off-time control circuit 4 which controls the off-time $T_{OFF}$ thereby controlling the dwell angle.

At first, discussion will be made on how the off-time $T_{OFF}$ should be controlled for controlling the dwell angle in order to achieve an optimum spark ignition performance. It is the purpose of the dwell angle control in the internal combustion engine that the primary current $i_c$ supplied to the ignition coil 12 attains the predetermined level $i_{co}$ to assure a stable spark ignition performance in any one of the engine rotational speed ranges. Generation of heat in the output stage transistor 10 occurs necessarily throughout the period of time $T_i$ during which the transistor 10 operates in its active region with the primary current $i_c$ being maintained at the predetermined level $i_{co}$. Therefore, the temperature rise of the output stage transistor 10 is substantially proportional to the ratio $T_i/T$ between the constant current time $T_i$ and the ignition period T. Thus, when the constant current time $T_i$ is excessively long, the temperature rise of the output stage transistor 10 becomes so excessive that the transistor 10 will be finally destroyed. It is therefore desirable to maintain the ratio $T_i/T$ at an appropriate value in any one of the engine rotational speed ranges. In a numerical expression, the dwell angle control is a manner of control which establishes and maintains the relation $T_i/T=K_o$, where $K_o$ is a constant. The value of $K_o$ is generally set at $K_o \approx 0.01$ to 0.1 and is preferably as small as possible.

Figure 1:
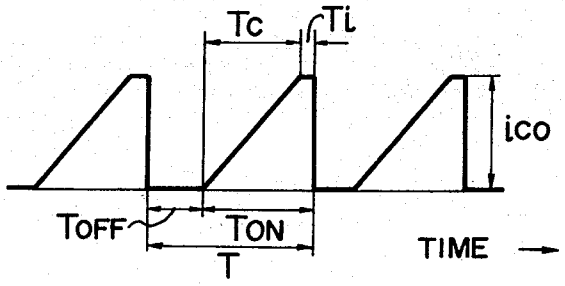
FIG. 1 PRIOR ART
FIG. 1 shows the waveform of primary current supplied to the ignition coil in the prior art contactless ignition system which can also be used in explaining the system of the present invention.

How the off-time $T_{OFF}$ should be controlled to maintain constant the ratio $T_i/T$ will be discussed with reference to FIG. 1. Referring to FIG. 1, $T_{OFF}$ is given by $$T_{OFF}=T-T_c-T_i=T[1-(T_c/T)-(T_i/T)]$$

In the above equation, T is the reciprocal of the number of revolutions F of the engine per unit time and is thus expressed as $T=1/F$. Since $T_i/T=K_o$ which is a constant, $(1-T_i/T)$ is also a constant and is now expressed as $1-T_i/T=1-K_o=K_1$. Let the variable $T_c/T$ be $K_2$, then, $T_{OFF}$ can be expressed as $$T_{OFF}=(K_1-K_2)/F$$

In the present invention, the primary current $i_c$ supplied to the primary winding of the ignition coil 12 is detected by a current detecting resistor 11, and a train of pulses each indicative of the rising time $T_c$ is generated from a rising time ($T_c$) detecting circuit 8 so that an information signal indicative of $K_2=T_c/T$ can be applied to the off-time control circuit 4. This off-time control circuit 4 comprises a monostable multivibrator which provides an output signal indicative of $T_{OFF}=(K_1-K_2)/F$ for controlling the off-time $T_{OFF}$. As a result, the dwell angle is so controlled as to satisfy the relation $T_i/T=K_o$, thereby minimizing generation of heat in the output stage transistor 10. The primary current $i_c$ attains the predetermined current level $i_{co}$ in any one of the engine rotational speed ranges, thereby ensuring a stable spark ignition performance at all the speeds. In the present invention, the rising time $T_c$ of the primary current $i_c$ is detected to determine the off-time $T_{OFF}$ on the basis of which the dwell angle is controlled. Therefore, the ratio $T_i/T=K_o$ can be maintained constant regardless of a deviation of the inductance of the ignition coil 12 in use from the designed setting.

The rising time $T_c$ of the primary current $i_c$ is also variable depending on the power supply voltage supplied from a battery 13, and in the prior art, a function related to variations of the power supply voltage affecting the dwell angle control had to be used for compensating for these variations of the power supply voltage, if any. In the present invention, $T_c$ is detected by the $T_c$ detecting circuit 8, and the signal indicative of the detected value of $T_c$ is applied to the off-time control circuit 4. The present invention has therefore the advantage that a circuit for compensating variations of the power supply voltage is utterly unnecessary, and the relation $T_i/T=K_o$ can be always ensured in a strict sense. Further, due to the fact that the frequency range F and the type of the ignition coil employed in an internal combustion engine differ from those in another engine depending on the number of cylinders thereof, it has been necessary to alter the time constant of the dwell angle control means in the prior art contactless ignition system. In contrast to this, the operating frequency range F and the rising time $T_c$ of the primary current $i_c$ supplied to the ignition coil 12 are detected in the present invention for the purpose of control of the dwell angle. Therefore, the present invention provides such an additional advantage that the same contactless ignition system can be used, without any structural alteration, for the control of a variety of engines having different numbers of cylinders, and because of this advantage, the ignition system can be mass-produced at low costs.

The output from the off-time control circuit 4 in the ignition system having the aforementioned advantages is applied through the OR circuit 5 and the output stage buffer 6 to the output stage transistor 10 to control the dwell angle in the ranges of intermediate and high rotational speeds of the engine. An abnormal voltage detecting circuit 9 shown in FIG. 2 is provided to turn off the output stage transistor 10 in the event in which the power supply voltage becomes unusually high.

Figure 3A:
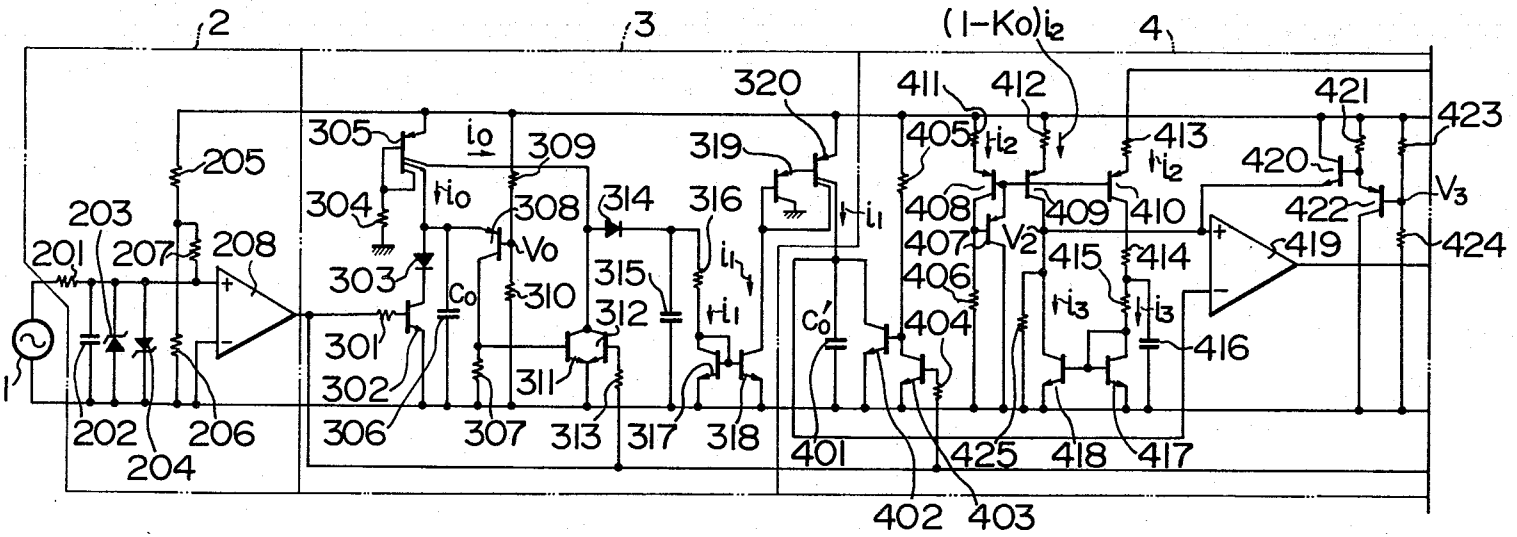
FIGS. 3A and 3B are detailed electrical circuit diagrams of the system shown in FIG. 2.
Figure 3B:
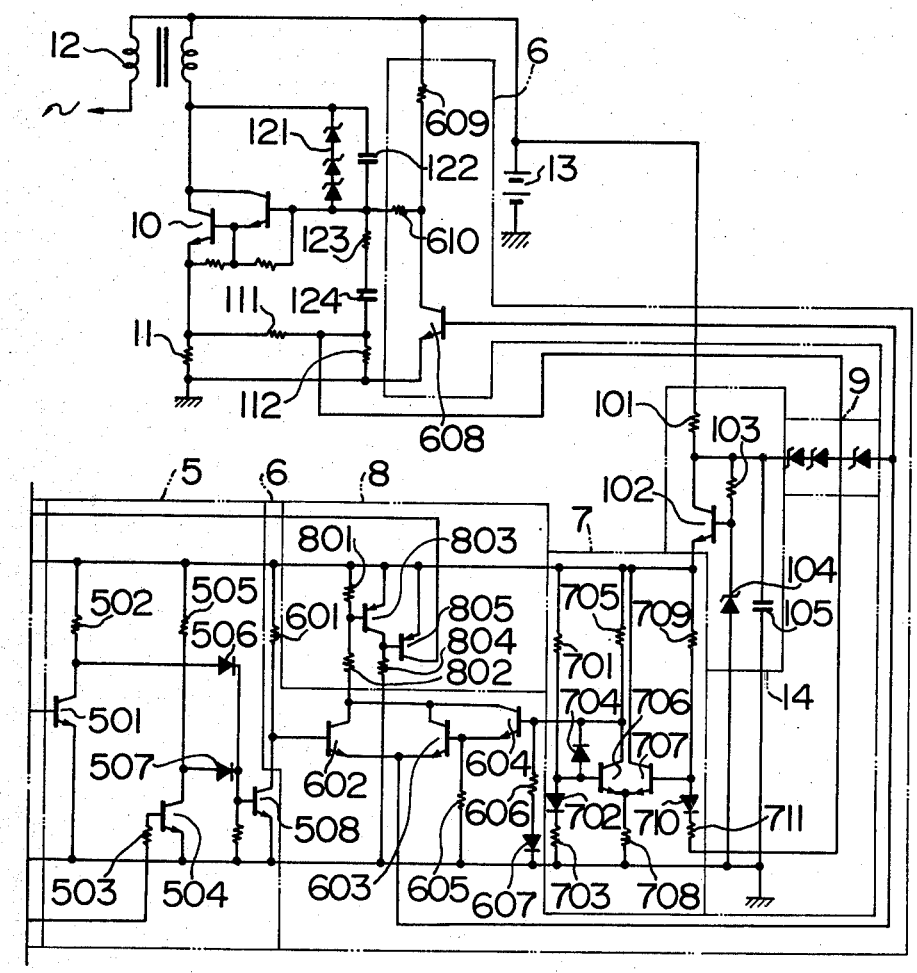
Figure 4:
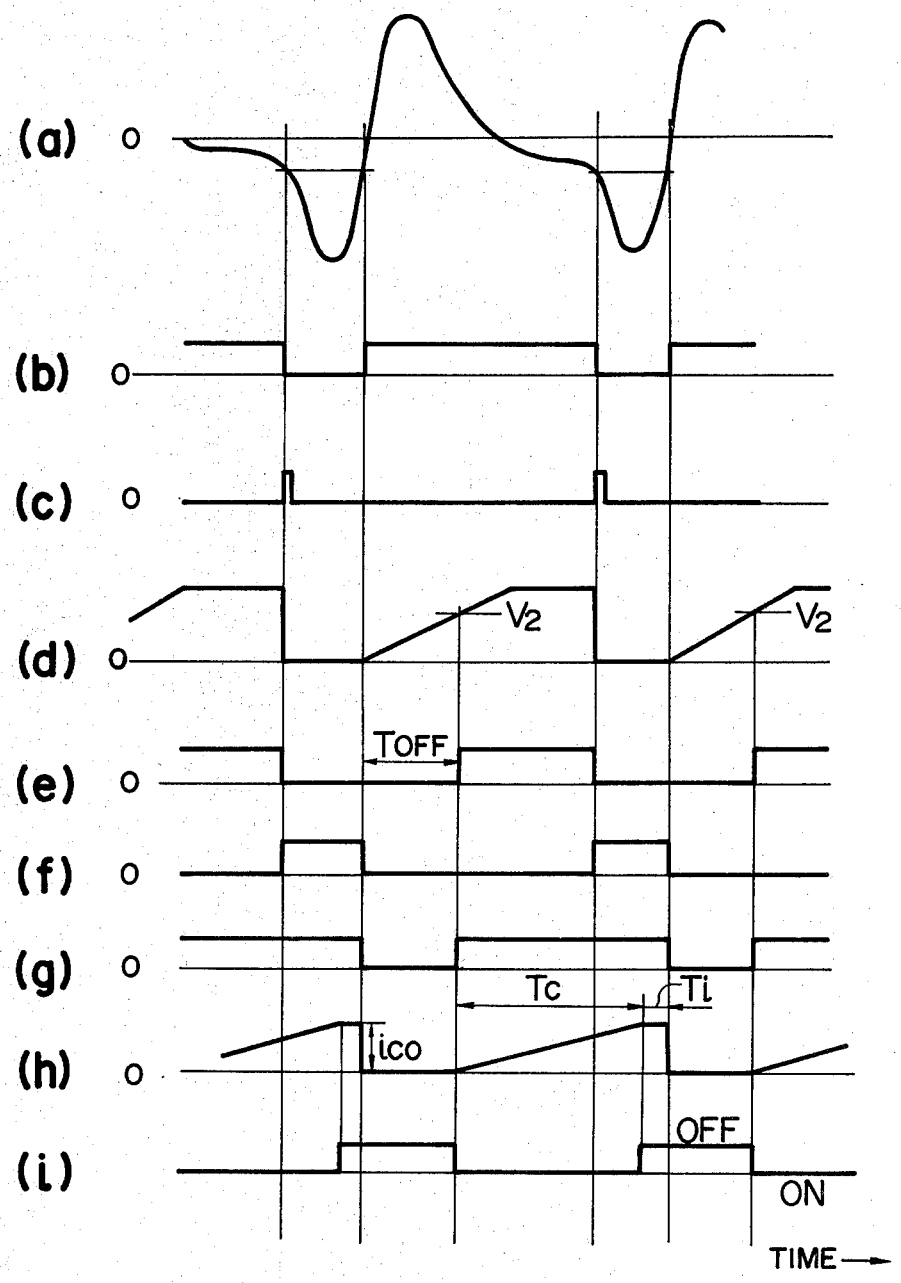
FIG. 4 shows various signal waveforms to illustrate the operation of the system shown in FIGS. 3A and 3B.

The detailed circuit structure of the ignition system of FIG. 2 is shown in FIGS. 3A and 3B, and signal waveforms appearing at various portions in FIGS. 3A and 3B are shown in FIG. 4. The AC generator 1 generates an AC output having a waveform as shown in (a) of FIG. 4 to determine the ignition timing depending on the factors including the engine rotation speed and the intake manifold vacuum. This AC output is applied to the rectangular wave shaping circuit 2 in which resistors 201, 205, 206 and 207 determine the threshold level and the resultant signal is passed through a comparator 208 to appear as a rectangular waveform as shown in (b) of FIG. 4. The rising edge of this rectangular waveform indicates the ignition timing (the timing of interrupting the primary current $i_c$ supplied to the ignition coil 12) as described later. A capacitor 202 and Zener diodes 203, 204 are provided for eliminating noise and protecting the comparator 208 against ones. In the range of low rotational speeds such as the idling rotatonal speed of the engine, the output of rectangular waveform from the rectangular wave shaping circuit 2 is applied through resistors 503, 505, transistors 504, 508 and a diode 507 in the OR circuit 5 to resistors 601, 609, 610 and transistors 602, 608 in the output stage buffer 6 to drive the output stage transistor 10.

The F-I converter circuit 3 comprises a constant current source (whose constant current value is $i_o$) composed of a resistor 304 and a multi-collector transistor 305; a reference voltage source (whose reference voltage is $V_o$) composed of resistors 309 and 310; a capacitor 306 (whose capacitance value is $C_o$); an output current generating circuit composed of a capacitor 315, a resistor 316 and transistors 317, 318, 319, 320; and a switching circuit composed of resistors 301, 307, 313, transistors 302, 308, 311, 312 and diodes 303, 314. When the output signal from the comparator 208 in the rectangular wave shaping circuit 2 changes to its "0" level, the transistors 302 and 312 in the F-I converter circuit 3 are turned off. As soon as the transistor 302 is turned off, the capacitor 306 is charged with the constant current $i_o$, and when the voltage charge across this capacitor 306 exceeds a reference voltage $V_o$ determined by the resistors 309 and 310, the transistor 308 is turned on to turn on the transistor 311. Then, when the output signal from the comparator 208 in the rectangular wave shaping circuit 2 changes to its "1" level from its "0" level, the transistors 302 and 312 are turned on. Since the transistor 302 is turned on, the charge stored in the capacitor 306 is instantaneously discharged, and the transistors 308 and 311 are turned off. Thus, a signal of "1" level having a constant pulse width determined by $(C_o \cdot V_o)/i_o$ as shown in (c) of FIG. 4 appears at the common-connected collectors of the transistors 311 and 312 each time the output signal from the comparator 208 changes to its "0" from its "1" level. Since the capacitor 315 is continuously charged with the constant current $i_o$ during the constant period of time of $(C_o \cdot v_o)/i_o$ during which the signal appearing at the common-connected collectors of the transistors 311 and 312 remains in its "1" level, the voltage charge across this capacitor 315 corresponds to the frequency of the output signal from the comparator 208, hence, to the rotation speed F of the engine, and an output current proportional to the voltage charge across the capacitor 315 passes through the transistors 317, 318 and 319 to appear at the collector of the transistor 320. The output current appearing from the F-I converter circuit 3 is now designated by $i_1$. Then, from the relation between the charge current and the discharge current of the capacitor 315, the following equations are obtained:

$$\frac{C_o \cdot V_o}{i_o} \cdot i_o = T \cdot i_1$$

(where T is the pulse period of the output from the comparator 208.)

$$i_1 = \frac{C_o \cdot V_o}{T} C_o \cdot V_o \cdot F$$

(where F is the pulse frequency of the output from the comparator 208.)

The off-time control circuit 4 comprises a monostable multivibrator circuit which generates a signal indicative of the off-time $T_{OFF}=(K_1-K_2)/F$ in response to the supply of the current $i_1$ proportional to the engine rotational speed F from the F-I converter circuit 3. The off-time control circuit 4 includes a constant current generating circuit composed of resistors 406, 411, 412, 413, 414, 415, 425, transistors 407, 408, 409, 410, 417, 418 and a capacitor 416. This constant current generating circuit is so designed that a current $i_2$ flows through the resistor 411, and a current given by $(1-K_o)\cdot i_2=K_1\cdot i_2$ flows through the resistor 412. A transistor 805 in the $T_c$ detecting circuit 8 is so arranged that it is turned on and kept in that state during only the rising time $T_c$ of the primary current $i_c$ supplied to the ignition coil 12, and the current $i_2$ flows through the resistor 413 in the on-state of the transistor 805. At this time, a current $i_3$ flows through the resistor 415. From the relation between the charge current and the discharge current of the capacitor 416, the following equation holds:

$$T_c \cdot i_2 = T \cdot i_3$$

$$\therefore i_3 = (T_c/T) \cdot i_2 = K_2 \cdot i_2$$

The same current $i_3$ flows as the collector current of the transistor 418. Therefore, a voltage $V_2$ given by $V_2=R_2\cdot(K_1\cdot i_2-i_3)=R_2\cdot i_2(K_1-K_2)$ (where $R_2$ is the resistance value of the resistor 425) is applied to the non-inverting input terminal of a comparator 419.

The output from the comparator 208 in the rectangular wave shaping circuit 2 is also applied through the resistors 404, 405 and the transistor 403 to turn on and off the transistor 402. When this transistor 402 is turned on, the charge stored in the capacitor 401 is instantaneously disharged, while when the transistor 402 is turned off, the capacitor 401 is charged with the constant current $i_1=(C_o \cdot V_o \cdot F)$ supplied from the F-I converter circuit 3. Therefore, a generally triangular output waveform as shown in FIG. 4*d* appears from the capacitor 401 which has a capacitance value $C_o'$. Since such a voltage is applied from the capacitor 401 to the inverting input terminal of the comparator 419, the off-time $T_{OFF}$ indicated by the output signal from the comparator 419 is given by $$T_{OFF} = \frac{C_o' \cdot V_2}{i_2} = \frac{C_o' \cdot R_2 \cdot i_2(K_1 - K_2)}{C_o \cdot V_o \cdot F}$$

Suppose that $C_o \approx C_o'$, then $T_{OFF}$ is expressed as $$T_{OFF} = \frac{R_2 \cdot i_2}{V_o} \cdot \frac{K_1 - K_2}{F}$$

In the contactless ignition system performing the above manner of control, the dwell angle can be controlled so as to maintain the relation $T_i/T=K_o$, where $K_o$ is the constant provided by the ratio between the resistance values of the resistors 411 and 412, and the heat generated in the output stage transistor 10 can be minimized. Further, the primary current $i_c$ supplied to the ignition coil 12 attains the predetermined constant current level $i_{co}$ in the ranges of intermediate and high rotational speeds of the engine so that the desired stable spark ignition performance can be exhibited at these speeds. It is the function of the transistors 420, 422 and resistors 421, 423, 424 that a voltage $V_3$ determined by the resistors 423 and 424 provides a minimum voltage $V_{2MIN}$ applied to the non-inverting input terminal of the comparator 419. Thus, $T_{OFFMIN}$ is given by $$T_{OFFMIN} = \frac{C_o \cdot V_3}{i_1}$$

$$\therefore \frac{T_{OFFMIN}}{T} = \frac{C_o \cdot V_3}{C_o \cdot V_o \cdot F \cdot T} = \frac{V_3}{V_o} = \text{a constant}$$

It will thus be seen that a limit is provided for the maximum dwell angle so that the dwell angle may not become excessively large even in the presence of, for example, noise.

The output from the off-time control circuit 4 is applied through transistors 501, 508, a resistor 502 and a diode 506 in the OR circuit 5 to the resistors 601, 609, 610 and transistors 602, 608 in the output stage buffer 6 to drive the output stage transistor 10. The capacitor 401 in the off-time control circuit 4 is not charged while the output signal from the comparator 208 is in its "0" level. Consequently, a collector signal, which takes its "0" level during the period of time of the sum of the "0" level duration of the output from the comparator 208 and the off-time $T_{OFF}$ as shown in (e) of FIG. 4, appears at the collector of the transistor 501 in the OR circuit 5. A collector signal which takes its "1" level during the "0" level duration of the output from the comparator 208 as shown in (f) of FIG. 4, appears at the collector of the transistor 504 in the OR circuit 5. The diodes 506 and 507 act as an OR gate for the collector signals of the transistors 501 and 504, so that a signal having a waveform as shown in (g) of FIG. 4 is applied to the base of the transistor 508. Since the output stage transistor 10 is finally triggered by the signal having the waveform shown in (g) of FIG. 4, the collector current of the output stage transistor 10, hence, the primary current $i_c$ supplied to the primary winding of the ignition coil 12 has a waveform as shown in (h) of FIG. 4. It will be seen from (h) of FIG. 4 that the off-time $T_{OFF}$ of the primary current $i_c$ supplied to the primary winding of the ignition coil 12 is controlled in the manner above described.

The primary current $i_c$ supplied to the primary winding of the ignition coil 12 flows through the current detecting resistor 11, and a voltage having a level corresponding to the detected primary current value is generated across this resistor 11. This voltage is applied through resistors 111 and 112 to the constant current control circuit 7. This constant current control circuit 7 comprises a differential amplifier composed of resistors 701, 703, 705, 708, 709, 711, diodes 702, 704, 710 and transistors 706, 707. In the constant current control circuit 7, the resistors 701, 703 and diode 702 establish a reference voltage, and the voltage corresponding to the detected primary current value is applied to the diode 710. An output representing the difference between the above voltages appears at the collector of the transistor 706. Depending on the level of this collector output, transistors 603, 604, resistors 605, 606 and a diode 607 in the output stage buffer 6 act to increase the base current supplied to the transistor 608 so that, as soon as the value of the primary current $i_c$ exceeds the predetermined setting $i_{co}$, the operating region of the output stage transistor 10 is shifted to the unsaturated region or active region, thereby limiting the maximum value of the primary current $i_c$ to the predetermined setting $i_{co}$. The output stage transistor 10 interrupts the flow of the primary current $i_c$ to the primary winding of the ignition coil 12 in synchronism with the rise time of the output ((b) in FIG. 4) from the wave shaping circuit 2, thereby inducing a spark ignition voltage across the secondary winding of the ignition coil 12.

The $T_c$ detecting circuit 8 is composed of resistors 801, 802, 804 and transistors 803, 805. During the off-time $T_{OFF}$ in which the transistor 602 is in its on-state since the base potential of the transistor 508 is in its "0" level, and during the period of time in which the transistor 603 is operating in the unsaturated region since the value of the primary current $i_c$ exceeds the predetermined setting $i_{co}$, the transistor 803 is turned on to turn off the transistor 805 and remains in that state. During the other period of time, the transistor 803 is turned off to turn on the transistor 805 and remains in that state. The waveform (i) of FIG. 4 shows the on-off waveform of the transistor 805. It will be seen from (i) of FIG. 4 that the transistor 805 is turned on as soon as the supply of the primary current $i_c$ to the primary winding of the ignition coil 12 is started, and it is kept in that state for the period of time $T_c$ at the end of which the primary current $i_c$ attains the predetermined level $i_{co}$.

A constant voltage circuit 14 is composed of resistors 101, 103, a transistor 102, a Zener diode 104 and a capacitor 105. This circuit 14 is provided to stabilize the power supply voltage of the battery 13 so that a constant voltage can be applied to the individual circuits.

The abnormal voltage detecting circuit 9 is composed of three Zener diodes connected in series with each other. In the event in which the power supply voltage of the battery 13 becomes unusually high or exceeds a predetermined level, all of the Zener diodes conduct to supply the base current to the transistor 608 in the output stage buffer 6, thereby turning on the transistor 608 to turn off the output stage transistor 10.

A plurality of Zener diodes 121 are connected to across the base and the collector of the output stage transistor 10 so that, when a surge voltage induced in the primary winding of the ignition coil 12 exceeds a predetermined setting, the output stage transistor 10 is turned on, and such a surge voltage is absorbed by the diodes. Capacitors 122, 124 and a resistor 123 are also provided to prevent oscillation of the output stage transistor 10.

In the aforementioned embodiment of the present invention, the output from the rectangular wave shaping circuit 2 is applied to the F-I converter circuit 3 to obtain an output current $i_1$ proportional to the rotation speed F of the engine. However, the elements 391 to 313 in the F-I converter circuit 3 may be eliminated, and the AC output of the AC generator 1 may be directly connected through a resitor (not shown) to the anode of the diode 314. In this modification, the AC output from the AC generator 1 is directly rectified and smoothed by the combination of the diode 314 and the capacitor 315 to provide similarly the output current $i_1$ proportional to the rotation speed F of the engine.

Also, in the aforementioned embodiment, the AC output from the AC generator 1 is shaped into a rectangular waveform by the rectangular wave shaping circuit 2. However, a rectangular waveform generating circuit including an element such as a Hall element or a phototransistor generating a rectangular pulse signal in synchronism with the rotation of the engine may be employed to eliminate both of the AC generator 1 and the rectangular wave shaping circuit 2.

Further, in the aforementioned embodiment, the maximum value of the primary current $i_c$ is limited to a predetermined setting $i_{co}$ by the constant current control circuit 7. However, according to the principle of the present invention, the rising time $T_c$ of the primary current $i_c$ from the current supply starting time to the time of attainment of its predetermined setting $i_{co}$ is detected for the control purpose. Therefore, when the time of attainment of the predetermined setting $i_{co}$ of the primary current $i_c$ is selected to substantially coincide with the ignition timing, the maximum value of the primary current $i_c$ need not necessarily be limited to such a predetermined setting $i_{co}$.

As described in detail hereinbefore, the present invention is featured by the fact that the rising time $T_c$ of the primary current $i_c$ is detected to control the dwell angle of the ignition coil. Although the off-time control circuit 4 generating an output pulse indicative of $(K_1'K_2)/F$ is employed for the control of the dwell angle, it may be replaced by a modified off-time control circuit adapted for calculating the off-time on the basis of another way of calculation. Further, the on-time itself of the primary current supplied to the ignition coil may be directly controlled on the basis of the detected rising time $T_c$ for the control of the dwell angle.

What is claimed is:

1. A contactless ignition system for an internal combustion engine comprising:

an ignition coil including a primary winding and a secondary winding;

switching means connected to the primary winding of said ignition coil for controlling the starting time and interruption time of primary current supplied to said primary winding;

current detecting means connected to the primary winding of said ignition coil for detecting the level of primary current supplied to said primary winding;

a rising time detecting circuit connected to said current detecting means for detecting the rising period of time for the level of the primary current to attain a predetermined setting;

rotational speed detecting means for detecting the rotational speed of the engine; and a dwell angle control circuit connected to said switching means, said rising time detecting circuit and said rotational speed detecting means for controlling the starting time of primary current supplied to said primary winding by said switching means in response to the rising period of time detected by said rising time detecting circuit.

2. A contactless ignition system according to claim 1, wherein said dwell angle control circuit includes:

maximum dwell angle limiting means for preventing the starting of primary current supplied to said primary winding by said switching means before a predetermined dwell angle.

3. A contactless ignition system according to claim 1, further including a power source, and wherein said dwell angle control circuit further includes:

an abnormal voltage detecting circuit connected to said switching means and said power source for causing said switching means to interrupt the supply of the primary current to said primary winding when the voltage of said power source exceeds a predetermined limit.

4. A contactless ignition system for an internal combustion engine comprising:

an ignition coil including a primary winding and a secondary winding;

switching means connected to the primary winding of said ignition coil for controlling the starting time and interruption time of primary current supplied to said primary winding;

current detecting means connected to the primary winding of said ignition coil for detecting the level of primary current supplied to said primary winding;

a rising time detecting circuit connected to said current detecting means for detecting the rising period of time for the level of the primary current to attain a predetermined setting; and a control circuit connected to said switching means and said rising time detecting circuit for controlling the rising time of said primary current in accordance with the rising period of time detected by said current detecting means so as to render constant the relationship between the period during which the primary current equals the predetermined setting and the ignition period.

* * * * *